United States Patent [19]

Darias Paya

[11] 4,122,745

[45] Oct. 31, 1978

[54] STRINGED MUSICAL INSTRUMENT WITH AUXILIARY STRINGS

[76] Inventor: Francisco J. Darias Paya, Plaza Mayor, 4, Alcoy (Alicante), Spain

[21] Appl. No.: 769,462

[22] Filed: Feb. 17, 1977

[30] Foreign Application Priority Data

Feb. 17, 1976 [ES] Spain ..... 218.881

[51] Int. Cl.[2] ..... G10D 1/08; G10D 3/02

[52] U.S. Cl. ..... 84/267; 84/295; 84/298

[58] Field of Search ..... 84/267, 263, 293–295, 84/297, 298, 312, 314

[56] References Cited

U.S. PATENT DOCUMENTS

| | | | |
|---|---|---|---|
| 17,218 | 5/1857 | Hett | 84/295 |
| 712,550 | 11/1902 | Kriwulka et al. | 84/295 |
| 1,564,078 | 12/1925 | Lock | 84/294 |
| 2,124,243 | 7/1938 | Carter et al. | 84/295 X |

*Primary Examiner*—John Gonzales

*Attorney, Agent, or Firm*—Imirie, Smiley & Guay

[57] ABSTRACT

A stringed instrument, such as a guitar, is provided with one or more auxiliary strings which are parallel to the regular strings of performance and between the regular strings and the sound box or body to be actuated under the influence and vibrations of the regular strings.

5 Claims, 4 Drawing Figures

STRINGED MUSICAL INSTRUMENT WITH AUXILIARY STRINGS

BACKGROUND OF THE INVENTION

The quality of sound of stringed musical instruments of all types is primarily determined by the quality of materials and craftsmanship employed in the construction of such instruments. Guitars are one of the most popular instruments of this type in the world but due to the cost of manufacture, the sound quality of the great majority of the instruments is not as great as is desired. The present invention serves to improve sound quality without materially increasing costs and without altering the physical aspects of the instrument.

SUMMARY OF THE INVENTION

A stringed musical instrument such as a guitar with the conventional classic structure comprising a case, neck, pitch bar, peg bridge with pegs and strings is provided with longitudinal passageway means such as channels or ducts between the outer surface of the finger board and the adjacent surface of the neck, and auxiliary strings are disposed in the passageway means substantially parallel with and between the regular strings and the sound box or case. The auxiliary strings may be called strings of influence because they are actuated by the vibrations from the regular strings rather than by direct actuation. The passageway means may comprise channels or ducts in the inner portion of the pitch finger board.

The channels or ducts have sufficient cross-sectional area size or dimensions that they cannot affect the normal vibration of the auxiliary strings. As the finger board ends at the border of the opening in the body or case, the strings extend into their respective channels and follow the course along an inner parallel level to the regular strings of execution and then are fixed to the peg bridge.

The tuning of the auxiliary strings of influence is effected at the peg bridge itself, which is elongated to receive the additional pegs to accommodate the number of auxiliary strings of influence that are employed. The number of auxiliary strings can be varied according to the effect desired, for example, between the limits of one to eight.

DETAILED DESCRIPTION OF INVENTION

Figure 1:
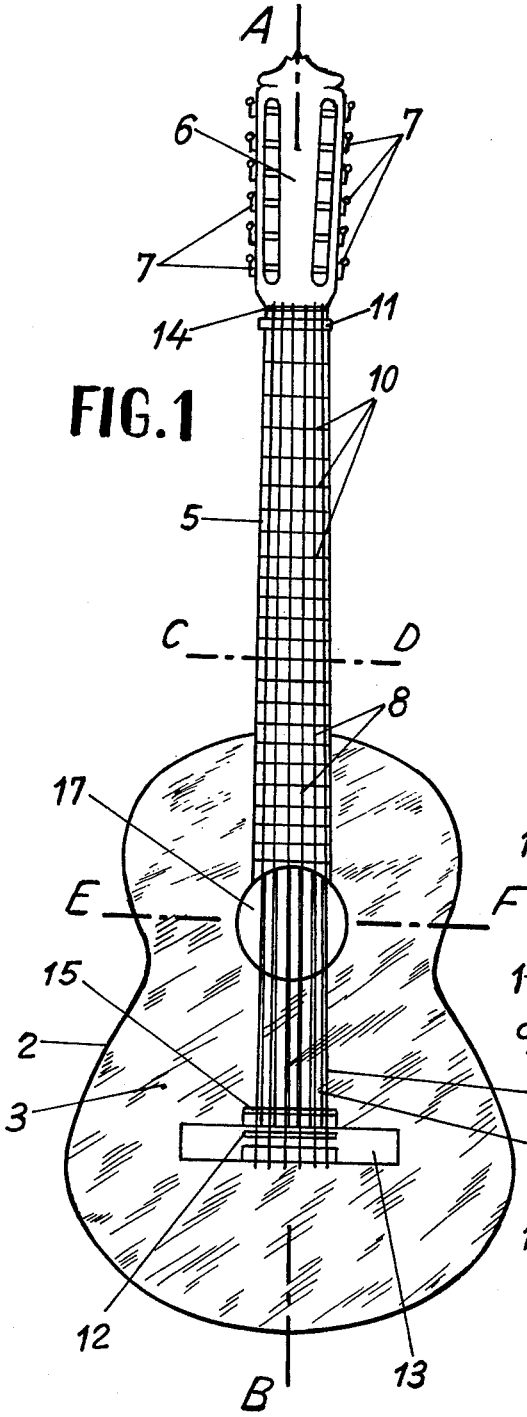
FIG. 1 is a plan view of a guitar according to the present invention.
Figure 2:
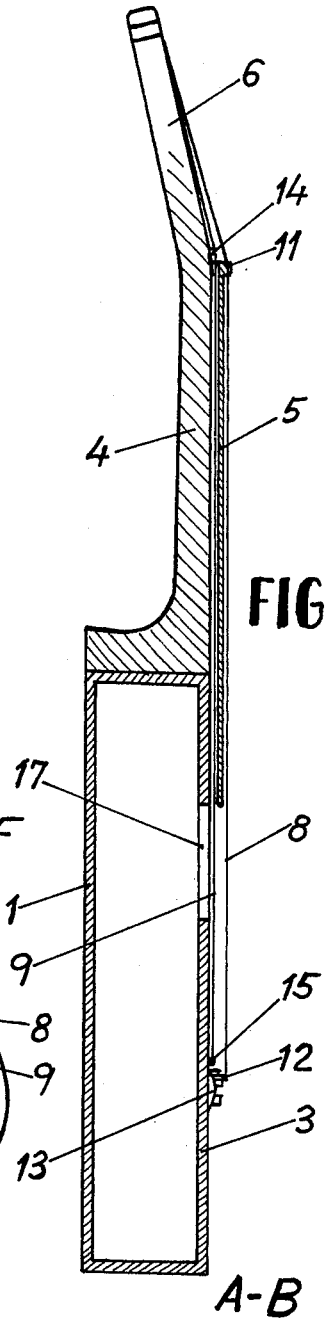
FIG. 2 is a cross-sectional view taken on line A–B of FIG. 1.
Figure 3:
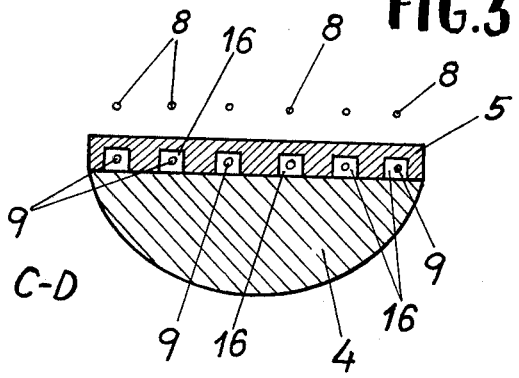
FIG. 3 is a cross-sectional view taken on line C–D of FIG. 1.
Figure 4:
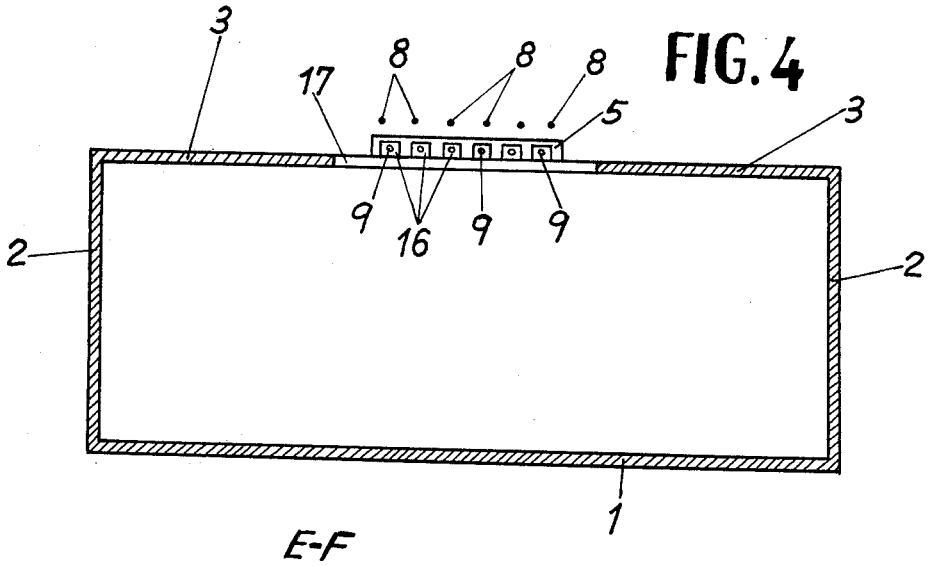
FIG. 4 is a cross-sectional view taken on line E–F of FIG. 1.

Referring now to the drawings, which show a guitar as an example of the invention, a sound box, body or case comprises a bottom 1 which together with a hoop 2 and a cover 3 form the body of conventional type. A neck 4 extends from one end of the body and carries a pitch 5 ending in a peg bridge 6 which, in this case, will have special dimensions, because it carries two sets of pegs 7, one set for the regular strings 8 of performance and the other set for auxiliary strings 9 that vibrate by influence, sympathy or resonance.

The set of regular strings 8 for the performance of the score will have the same form and dimensions as in conventional guitars, being operated in cooperation with the pitch 5 and frets 10, having the normal form. The strings 8 are stretched between an upper bridge 11 and a lower bridge 12 mounted on a base bridge 13 joined to the cover 3 of the guitar, resulting in a completely identical performance to that of any other guitar.

The auxiliary strings of vibration by influence 9 lie on a level between the regular strings 8 of performance and the cover 3 and bear upon an auxiliary upper bridge 14 and an auxiliary lower bridge 15 which can be mounted on the base bridge 13. The Auxiliary strings extend below the finger board 5 through longitudinal passageway means such as channels or ducts 16 in the lower or inner part of the finger board 5, the lower surface of which is fixed to the neck 4 of the guitar. These channels or ducts 16 can have any section providing they lodge conveniently the respective strings 9 and do not prevent their vibration.

The two sets of strings, those of performance 8 as also those of vibration by influence 9 are opposed to each other and centered over the opening 17 of the cover 3 with the purpose to obtain a better performance as to sonority and enlarged vibrations, thus being obtained the greatest effects, notwithstanding the dimensions and configuration of the instrument will not be strange to the performer.

The advantages of the invention contribute to the stringed instruments provided with auxiliary strings of vibration by influence known at present are among others:

With regard to the finger board: it enables a great number of additional auxiliary strings of influence (from 1 to 8) while maintaining the same size as the conventional finger boards and thus presents the same dimensions of the neck, so that its proportions do not annoy the performer. An enlargement of six strings for example in the systems known at present, whould make necessary the construction of a finger board of nearly double width than the conventional one and would mean being more uncomfortable. On the other hand, the improvements the invention introduces in the instruments do not reduce any sonority from the cover.

With regard to the peg bridge: it maintains identical proportions to the conventional ones being fastened on it all the strings, those of performance as also those of influence. As there is no increase in size, as would be the case when all strings were placed on the same level, their tightness on the cover is performed on the same points, thus it is not necessary to alter the distribution of the harmonic bars in its interior so that the conditions of vibration to the cover do not diminish.

With regard to the cover: it is well known that the cover is of vital importance, because it vibrates owing to the resonance of the strings and that to a smaller free surface of the cover corresponds less vibratory capacity. With the improvements according to the invention, the neck's surface that continues on the cover and extends to the opening, is the same as in the conventional instruments, while in other already existing systems the dimensions of the neck are increased in detriment of the free surface of the cover and thus of its vibratory capacity. These same reasons are identical with regard to the bridge.

With regard to the opening: the strings of performance as well as those of vibration by influence extend over the normal opening of the instrument, so that its yield is considerably increased. In the systems where the additional strings are situated at the same level, as compared to the problem in other systems that at least some of said strings lies beyond the opening, but if their number is six, for example, the outer ones are adjacent the sides of the surface of the cover of resonance.

There has also to be added that it is easily possible to completely or partially insonorize the strings of influence, in case one pretends, for example for certain pieces, to produce more differentiated sounds or atmospherical sounds.

In the improved guitar according to the invention, the length of the inferior strings of vibration by influence and of the superior ones of performance will be the same, and though the distance between the lower bridge and the upper bridge of the strings of performance and the lower strings that act by influence, sympathy or resonance, substantially is identical.

The auxiliary lower bridge for the auxiliary strings that act by influence and which is part of the improvements, can be constituted on the normal bridge in an additional way, being convenient that between the supporting points of the lower bridge and of the upper bridge exists an identical distance to the one of the normal strings of performance, though it is not absolutely necessary; if not, that the distances of support between the lower and the upper bridge of the two groups of strings can be the same or different.

The inferior strings of vibration by influence can be disposed at the same vertical level as their homonymous ones of performance or at different levels according to the needs of each case and of the number of strings used, and each of the strings of vibration by influence can be tuned in a completely independent way from the others.

The frets embedded in the finger board will not influence the longitudinal channels or ducts within the finger board (that is where the strings of vibration by influence pass), and in the case that said frets when being embedded in the finger board appear internally at the channels, they could be cut down to leave a passage to the strings which go through the interior of the longitudinal channels that exist in the lower part of the finger board without influencing at all the neck which will have on its whole length the proper section without any diminution, in order to resist the tension of the tuned strings.

The channels or ducts housing the auxiliary strings of vibration, can have any section providing they lodge the respective strings conveniently and do not prevent their normal vibration.

The type of strings to be used in the group of vibration by influence can be the same or different in quality, diameter, weight and the like as that of the strings of performance.

The dimensions of the guitar's peg bridge are enlarged to facilitate the insertion of the necessary pegs for tuning, of the strings of performance as well as of those of vibration by influence.

If desired there can be mounted on the guitar according to the invention a soft piece of felt or similar material among the inferior strings of vibration by influence and the guitar's case for the purpose to be able to eliminate the effects of vibration by influence at will of the user and in accordance with the musical composition to be played, so that it acts then as a normal guitar.

What is claimed is:

1. A stringed musical instrument comprising a case including a cover having an opening therein, an elongated neck extending from said case and carrying a peg bridge at its free end, a fret carrying finger board secured to the surface of said neck and passageway means including a plurality of individual passageways extending longitudinally through said neck and finger board between said cover and peg bridge, a lower string bridge mounted on said cover opposite said opening from said finger board, an upper string bridge mounted at the end of said finger board opposite said case, pegs rotatable mounted in said peg bridge, regular strings to be operated by a player individually anchored at one end to said lower string bridge and stretched over said case opening and along said finger board and over said upper string bridge to respectively individual pegs to be tensioned thereby, said strings being spaced from each other and disposed in a plane spaced from said cover and finger board, and a plurality of auxiliary strings disposed between said regular strings and said cover and extending over said opening and respectively through said individual passageways of said passageway means to a peg on said peg bridge.

2. An instrument according to claim 1 wherein said plurality of auxiliary strings are disposed in a plane parallel to the plane of said regular strings.

3. A stringed musical instrument comprising a case including a cover having an opening therein, an elongated neck extending from said case and carrying a peg bridge at its free end, a fret carrying finger board secured to the surface of said neck and passageway means extending longitudinally through said neck and finger board between said cover and peg bridge, a lower string bridge mounted on said cover opposite said opening from said fingerboard, an upper string bridge mounted at the end of said finger board opposite said case, pegs rotatable mounted in said peg bridge, regular strings to be operated by a player individually anchored at one end to said lower string bridge and stretched over said case opening and along said finger board and over said upper string bridge to respectively individual pegs to be tensioned thereby, said strings being spaced from each other and disposed in a plane spaced from said cover and finger board, and at least one auxiliary string disposed between said regular strings and said cover and extending over said opening and respectively through said individual passageways of said passegeway means to a peg on said peg bridge, an auxiliary lower string bridge secured to said case adjacent said first mentioned lower string bridge and to which one end of said at least one auxiliary string is anchored, and an auxiliary upper string bridge secured at the juncture of said neck and peg bridge and over which said at least one auxiliary string passes to the respective peg, the spacing of said auxiliary string bridges being substantially identical to that of said first mentioned string bridges so that the operational length of said regular and auxiliary strings substantially is equal.

4. An instrument according to claim 3 wherein said passageway means comprises a plurality of individual passageways, and a plurality of said auxiliary strings respectively extending through individual ones of said passageways.

5. An instrument according to claim 3 comprising a plurality of auxiliary strings disposed in a plane parallel to the plane of said regular strings.

* * * * *